US005190472A

United States Patent [19]

Voltz et al.

[11] Patent Number: 5,190,472

[45] Date of Patent: Mar. 2, 1993

[54] MINIATURIZED HIGH-DENSITY COAXIAL CONNECTOR SYSTEM WITH STAGGERED GROUPER MODULES

[75] Inventors: John A. Voltz, Hockessin; George A. Hansell, III, Newark, both of Del.

[73] Assignee: W. L. Gore & Associates, Inc., Newark, Del.

[21] Appl. No.: 856,780

[22] Filed: Mar. 24, 1992

[51] Int. Cl.[5] ..... H01R 11/00

[52] U.S. Cl. ..... 439/579

[58] Field of Search ..... 439/578-585, 439/607-610

[56] References Cited

U.S. PATENT DOCUMENTS 2,804,601 8/1957 Harthman et al. ..... 439/579
3,128,138 4/1964 Norchese ..... 439/579
3,219,963 11/1965 O'Keefe ..... 439/579

*Primary Examiner*—Joseph H. McGlynn
*Attorney, Agent, or Firm*—Dena Meyer Weker

[57] ABSTRACT

A miniaturized high-denisty coaxial interconnect system for use in termination of coaxial signal cables to electrical signal transmission systems is provided. The system contains one or more grouper modules having a staggered array of receptacle grooves in which the grouper modules are housed within a grouper frame. The system is easy to assemble and provide easy attachment and detachment from the transmission system. This invention also provides for an increased density of signal cables with improved spacing due to the unique design of component parts and their arrangement within the system.

37 Claims, 11 Drawing Sheets

MINIATURIZED HIGH-DENSITY COAXIAL CONNECTOR SYSTEM WITH STAGGERED GROUPER MODULES

FIELD OF THE INVENTION

The present invention relates to a miniaturized staggered high- density coaxial interconnect system for use in the termination of coaxial signal cables to electrical signal transmission systems, such as printed circuit boards (PCBs). The system is easy to assemble and provides easy attachment to and detachment from the transmission system. This invention also provides for an increased density of signal cables with improved spacing due to the unique design of component parts and their arrangement within the system.

BACKGROUND OF THE INVENTION

High speed computers and large scale integrated circuits and processes require the design of connectors with increased density, precision quality, and improved electrical performance.

In addition to the increased density of electrical leads, design parameters have imposed severe space limitations over the connector area to accommodate the ever increasing number of signals. These restraints lead to additional needs for matching or improving impedance control and attenuation and for minimizing noise and cross-talk in the region of the interconnection and transmission system (PCB). Quality of signal and minimal propagation delay must also be maintained.

There is a need for an improved arrangement of coaxial assemblies that minimizes spacing between electrical leads, provides for increased density and yet maintains the desired electrical characteristics and quality of transmission.

SUMMARY OF THE INVENTION

This invention relates to a high-density coaxial interconnect system having one or more modules, each module having an array of staggered receptacle grooves that receive coaxial cable connector assemblies.

Each coaxial cable connector assembly consists of a coaxial cable terminated to a coaxial connector system comprising a signal contact, an insulator, and a ground shell. The signal contact may be a four-beam contact or, and preferably a circular three-beam contact. The ground shell has a retention groove located on its exterior wall.

The coaxial cable connector assemblies are then connected to one or more grouper modules. Each grouper module is comprised of two rows having receptacle grooves located so that the grooves are staggered across the two rows. Each receptacle groove has a retention ridge which interacts with the retention groove of the coaxial cable connector ground shell. Other means may also be used to retain the coaxial cable connector assembly within the receptacle groove such as glue. The grouper modules are preferably made of an electronic grade engineering plastic.

One or more of these grouper modules are then fitted and held in place within a grouper frame. The module has shaped ends and interlocking means that allow easy entry within the grouper frame which is also constructed with shaped ends and interlocking means that match those of the modules and thus accommodate alignment, entry and retention. The grouper frame may be constructed from plastic or metal.

The grouper frame containing the coaxial cable connector assemblies and grouper modules mate with a header assembly. The header assembly comprises a header frame having a staggered array of receptacle holes that match those of the grouper assembly and alignment cones between receptacle holes. Contained within or adjacent to each receptacle hole of the header frame is a ground contact. The ground contact may be a reverse four-beam contact, a ground contact with an offset leg or a step down four-beam ground contact.

Attached to the other end of the ground contact is a header plate also containing an array of receptacle holes in which the location of the array is identical to that of the header frame and grouper frame. The header plate may have holes for ground pins located between receptacle holes.

Signal pins, ground pins and insulators are inserted into the header plate and the entire assembly then fits onto the surface of an electrical signal transmission system or alternatively into holes of an electrical signal transmission system such as a printed circuit board. The resulting assembly has an alternating ground signal configuration due to the staggered receptacle design of the modules. In this alternating ground and signal configuration, a ground pin is positioned between two signal pins. Likewise, a signal pin is positioned between two ground pins. The assembled header is affixed to the surface of the PC board and the staggered grouper assembly is held in contact with the header by appropriate hold-down frames, jack screws, both or other such mounting hardware known in the industry. A high density of ground and signal pins within a small area is thus achieved.

BRIEF DESCRIPTION OF THE DRAWINGS

FIG. 7 also represents a similar view of the offset leg ground contact at the point of contact between the signal pin and signal contact.

DETAILED DESCRIPTION OF THE INVENTION

The embodiments of the invention are best understood with reference to the accompanying drawings.

Figure 1:
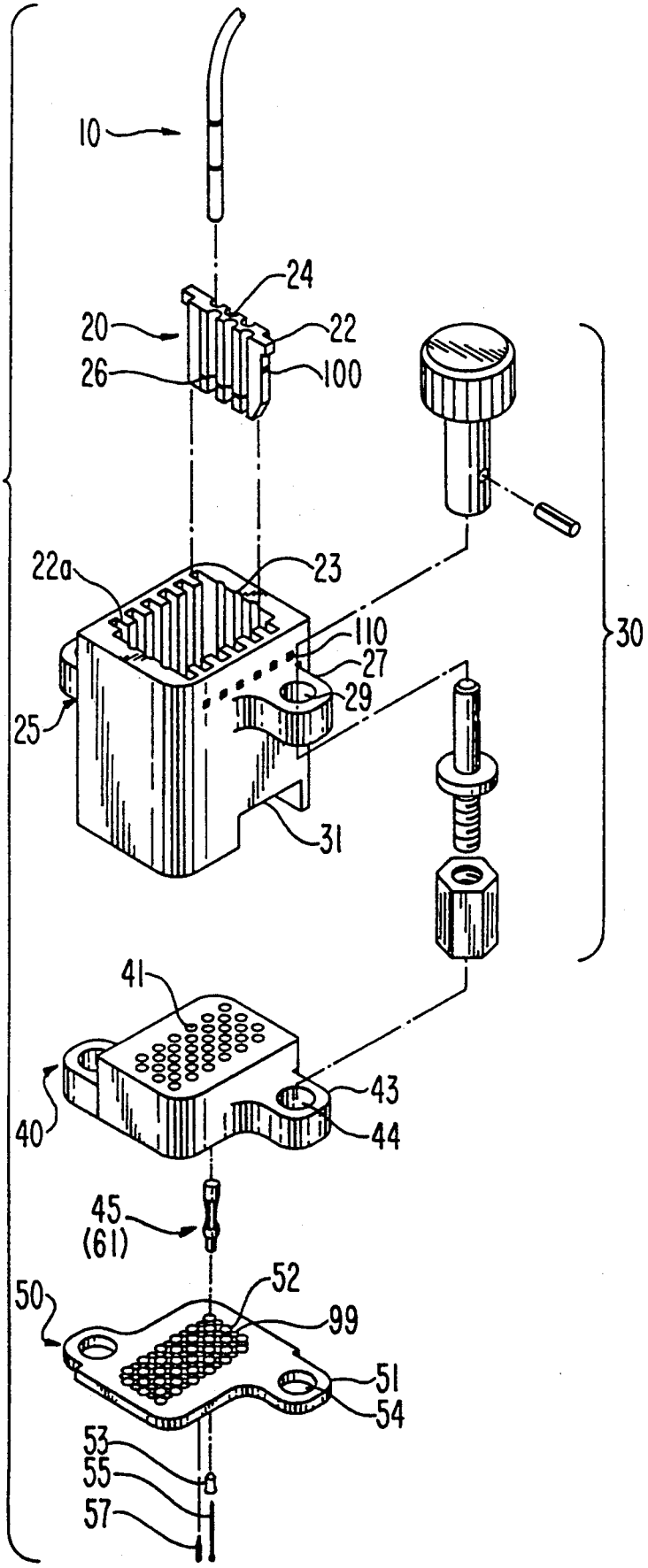
FIG. 1 is an exploded perspective view of the interconnect system with grouper module and a step-down ground contact.
Figure 1A:
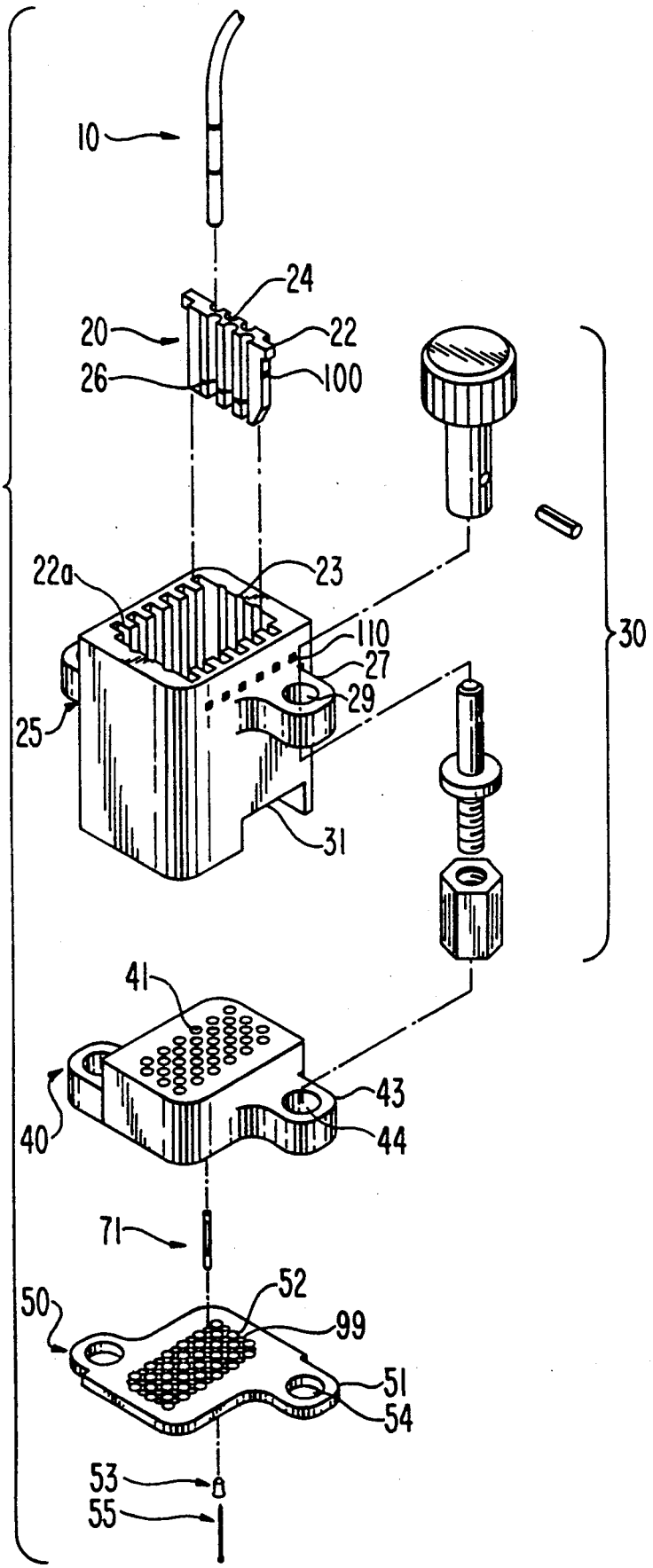
FIG. 1*a* is an exploded perspective view of the interconnect system with grouper module and a reverse four-beam ground contact.
Figure 1B:
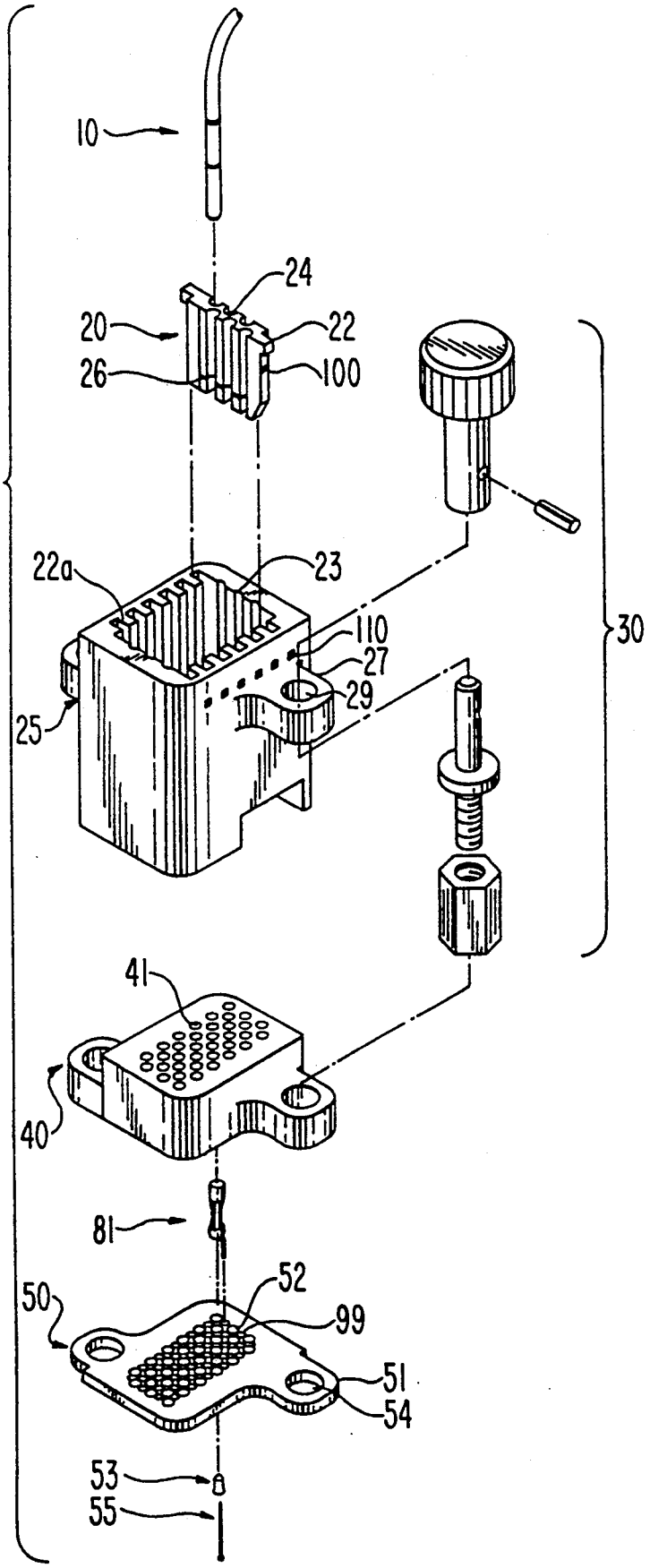
FIG. 1*b* is an exploded perspective view of the interconnect system with grouper module and an offset leg ground contact.

FIG. 1 shows in a vertically exploded perspective view the interconnect system of the invention including the following components: Coaxial cable connector 10, a grouper module 20 having a staggered array of receptacle grooves, a grouper frame 25, holding means 30, a header frame 40, a ground contact 45, a header plate 50 and an insulator 53, signal pin 55 and ground pin 57. Although the header assemblies may vary depending on which ground contact 45 is used as seen in FIGS. 1, 1*a* and 1*b*, the coaxial cable connector and grouper arrangement remain the same for all of the header assembly embodiments. FIG. 1 shows the use of a step-down ground contact as ground contact 45. FIG. 1*a* shows use of a reverse four-beam ground contact as ground contact 45. Likewise, FIG. 1*b* shows use of an offset leg ground contact as ground contact 45.

Figure 2:
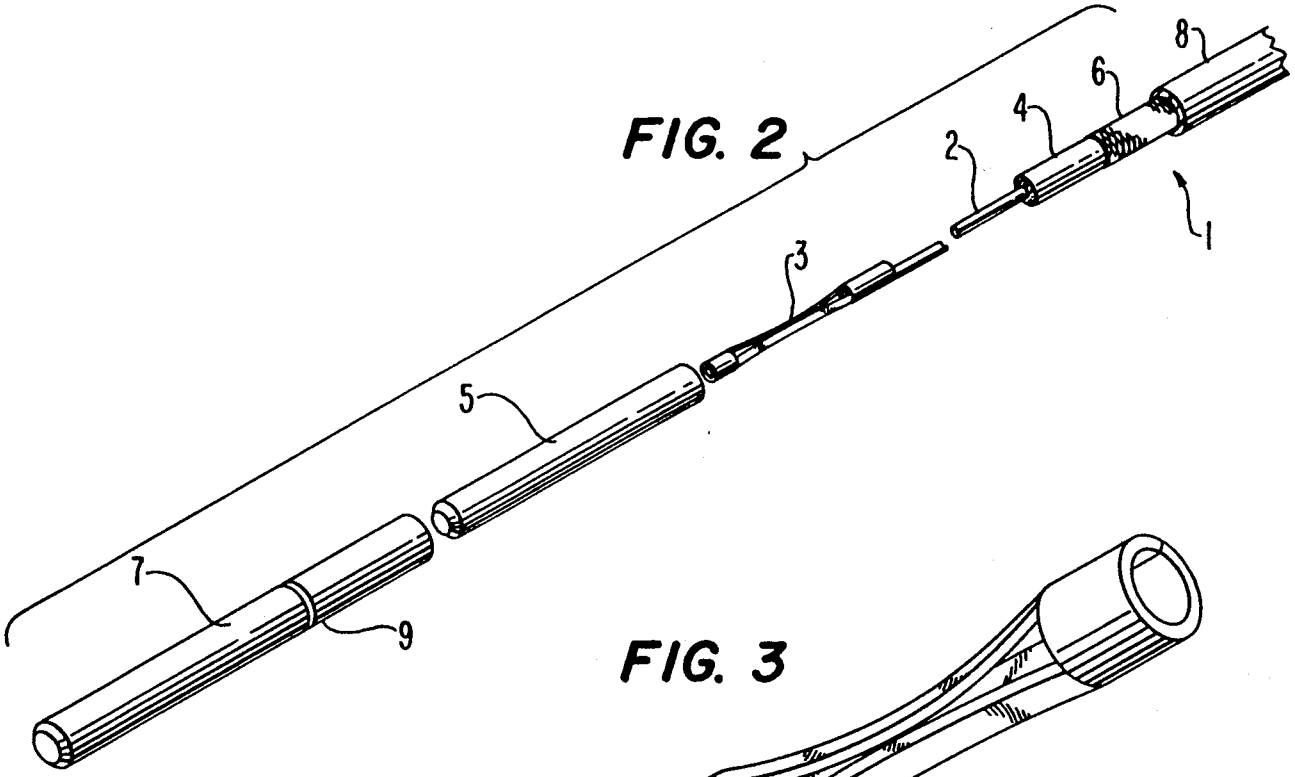
FIG. 2 shows an exploded perspective of a coaxial cable and contact assembly.

FIG. 2 shows a coaxial cable 1 having a signal carrying center conductor 2 surrounded by a dielectric material 4, further surrounded by an outer conductor 6 and a polymeric jacket 8. The center conductor may have a diameter of 0.010 in. (0.025 cm.) or less.

For any of the high speed coaxial cables used in this assembly, the dielectric material 4 is a thin layer of insulation and is most preferably a porous expanded polytetrafluoroethylene material such as that disclosed in U.S. Pat. Nos. 3,953,566 and 4,187,390 which is sold under the trademark GORE-TEX®, commercially available from W. L. Gore & Associates, Inc. of Newark, Del. Other thin layers of low dielectric porous or solid insulating materials are also suitable.

The outer conductor 6, preferably is a shield of copper, copper alloy, or other conductive material useful for ground circuits in current cable technology. FIG. 2 shows such an outer conductor in the form of a braided shield. Alternate forms of an outer conductor include served round or flat wire shields or one or more drain wires all of which is surrounded by an aluminum foil/-plastic film shielding, such as Mylar® a polyester, commercially available from E. I. DuPont de Nemours, Inc. The outer conductor 6 is wrapped or extruded with a protective polymeric jacket 8 which is impermeable to water and other contaminants and is also abrasion resistant. The diameter of the polymeric jacket containing the cable may be 0.054 in. (0.14 cm.) or less.

Figure 3:
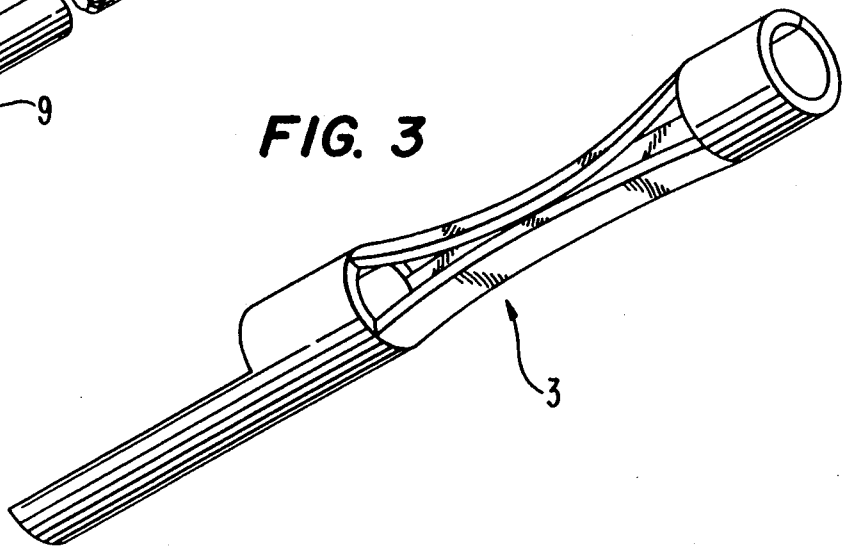
FIG. 3 shows a perspective of a cylindrical three-beam center contact.

The inner conductor 2 of the coaxial cable is connected to signal contact 3. FIG. 3 shows a close-up perspective view of the preferable shape of signal contact 3. This contact 3 comprises a three-beam cylindrical body and tail and may have a diameter of 0.026 in. (0.066 cm.) or less. The contact is preferably gold plated and preferably has a base material of a beryllium-copper alloy. Although other contact configurations are also suitable, this preferred contact provides sufficient normal and low insertion forces to maintain good interface between the contact and pin as well as being sufficiently small to enable plurality of coaxial cables to be positioned close together within a grouper.

The thermoplastic insulator 5 (shown in FIG. 2) separates the signal contact 3 from the conductive shell 7 and is preferably made of polyphenylene oxide.

The ground shell 7 may be made of a metal core of beryllium copper, phosphorus bronze, copper nickel alloy and preferably be plated with gold metal. The ground shell has a retention groove 9 positioned on its exterior wall which mates with a retention ridge of the receptacle grooves of grouper module 20 as will be described below.

When assembled, the center conductor 2 of the coaxial cable is first terminated with signal contact 3. This is accomplished by one of several methods known in the art including but not limited to crimping, soldering, or welding. The terminated coaxial cable contact is then inserted into the thermoplastic insulator 5 which is in turn attached to the ground shell 7. Termination between cable shield 6 and the connector shell 7 may also be accomplished by one of the aforesaid methods.

Figure 4:
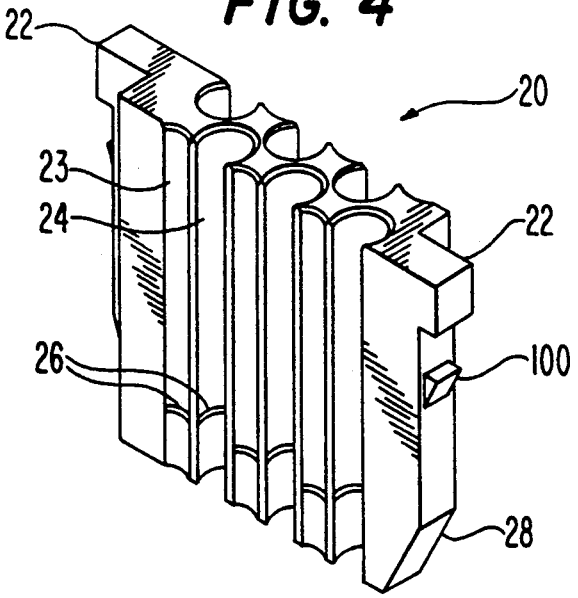
FIG. 4 is a perspective view from a side of the grouper module.
Figure 4B:
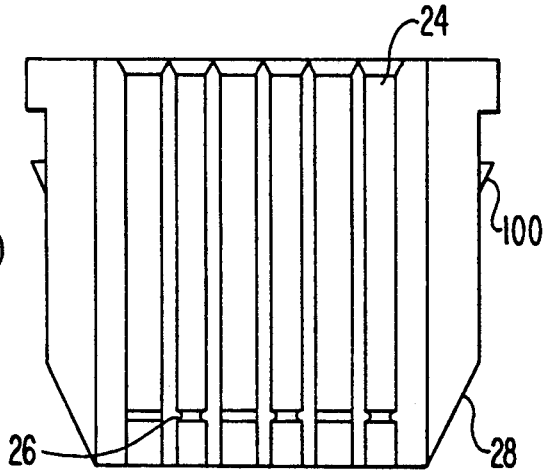
FIG. 4*b* is a side view of the grouper module.
Figure 4A:
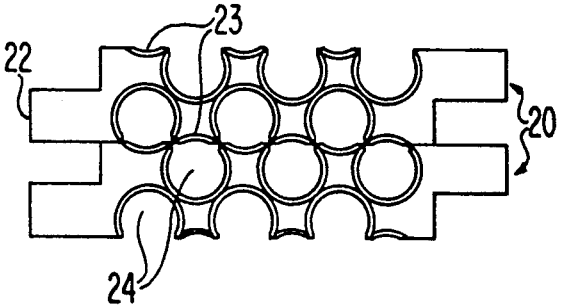
FIG. 4*a* is a top view of two grouper modules located adjacent each other.
Figure 4C:
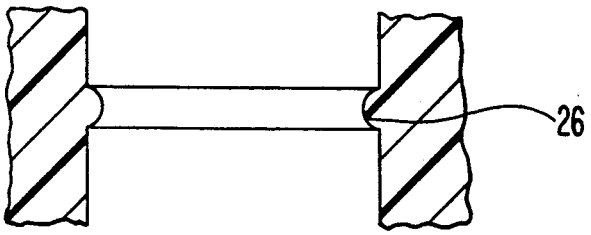
FIG. 4*c* is an enlarged sectional side view of a grouper module.

FIGS. 1–1*b* also show a grouper module 20 comprising two rows in which each row has a plurality of receptacle grooves 24. The receptacle grooves 24 are arranged so that they stagger across the two rows of the module. FIGS. 4–4*c* illustrate more clearly features of the grouper module.

Figure 4D:
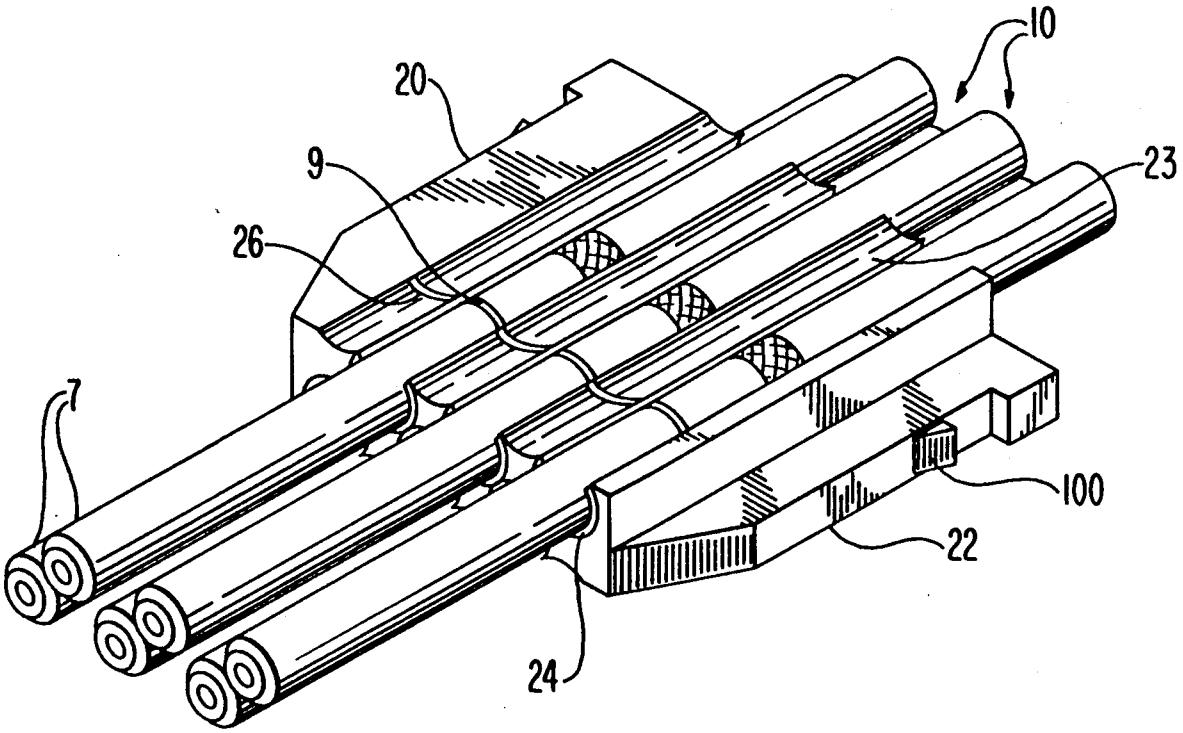
FIG. 4*d* is a close-up perspective of a module containing connector assemblies.

A requisite number of coaxial connector assemblies 10 are placed into the receptacle grooves 24 of the module. The assembly 10 is inserted so that the ground shell 7 extends beyond the module 20, as shown in FIG. 4*d*, so that they can be mated to signal pins and ground contacts of the header frame. The coaxial connector assemblies 10 are held in place within the grouper module by the retention groove 9 of the contact 7 that snaps and locks with the corresponding retention ridge 26 found within each receptacle groove 24.

The modules 20 may be designed to hold any desired number of receptacle grooves 24 in the range between two to thirty. The figures show three receptacle grooves per row. When modules 20 are assembled within a grouper frame, the grooves 24 match either a mating groove 23 from the adjoining module or a mating groove of the frame 25 thereby forming a receptacle hole as can be seen from the top view shown in FIG. 4*a*. The modules are molded from a thermoplastic such as liquid crystal polymers (LCP), polyetherimides (PEI), polybutylene terephthalate (PBT), nylon and polyethylene terephthalate (PET). The modules may also be made of an elastic thermoplastic material such as polyurethane (PU). A shaped end 28 (shown in FIG. 4) is preferably formed on the lower region of each module which aids in assembling the modules 20 into frame 25. The modules 20 and frame may also have shaped interlocking regions or keys 22 which cooperate with corresponding keys 22*a* of the grouper frame 25 thereby holding the modules in the proper location within the frame. The size of the frame 25 and number of keys provided within the frame depends on the number of modules needed for the particular application.

The modules 20 are held in the frame by locking means. FIG. 4*d* also shows the locking means comprising a locking tab 100 which interacts with a corresponding interlocking means such as window 110 on frame 25. Alternative locking means include use of glue and adhesives to hold the modules in place.

A grouper frame 25 is a four-sided housing. FIGS. 1–1*b* show extensions 27 projecting from two opposite sides. These extensions 27 contain holes 29 which provide for easy alignment and insertion of holding means 30 such as the thumb screws. Also provided at the bottom of grouper frame 25 is a cut-out 31 which allows easy alignment, fitting and attachment of header frame 40 to the grouper frame 25. Grouper frame 25 may be made of a thermoplastic such as nylon, LCP, PEI, PBT, and PET, or metal such as aluminum, zinc alloy, brass, or copper alloy.

Figure 5:
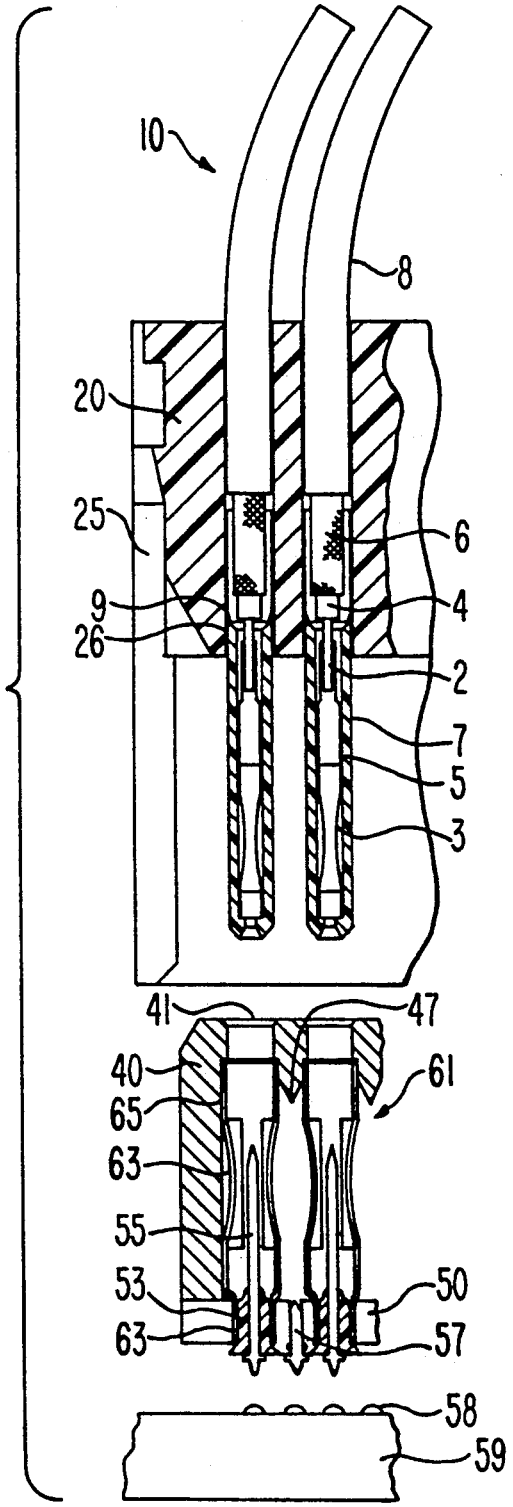
FIG. 5 is a cut-through side view of the assembled coaxial cable in the grouper frame and the assembled header frame with which it mates. The ground contact shown in this figure is a step-down ground contact.
Figure 5A:
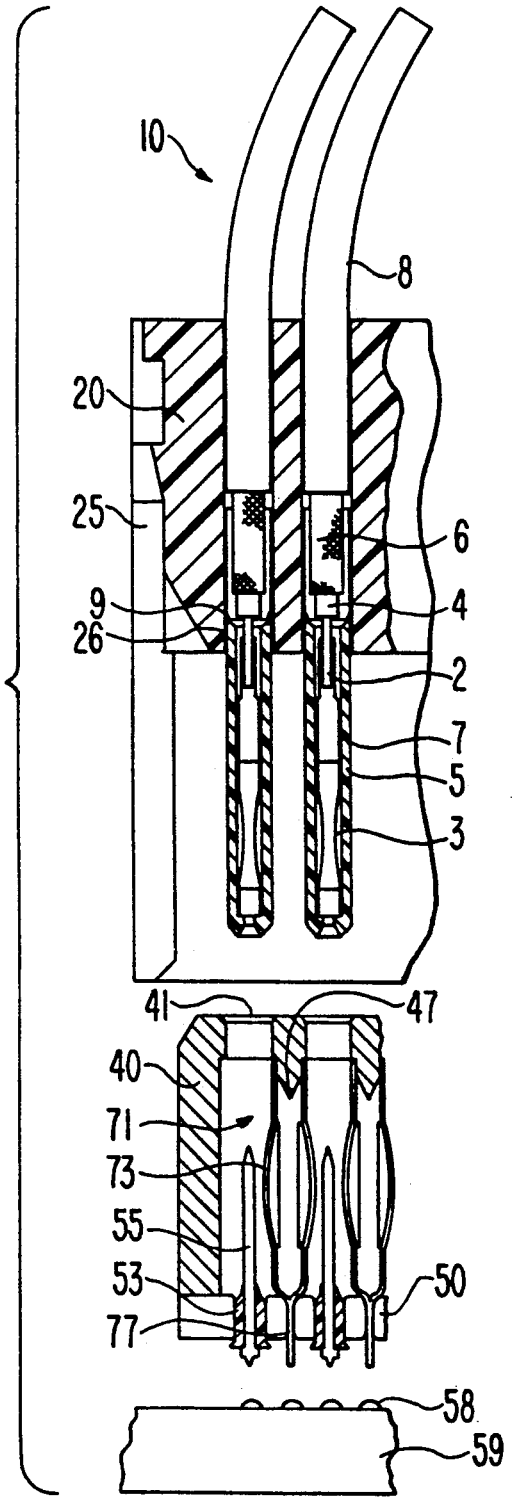
FIG. 5*a* is a cut-through side view of the assembled coaxial cable in the grouper frame and the assembled header frame with which it mates using a reverse four-beam ground contact corresponding to the embodiment shown in FIG. 1*a*.
Figure 5B:
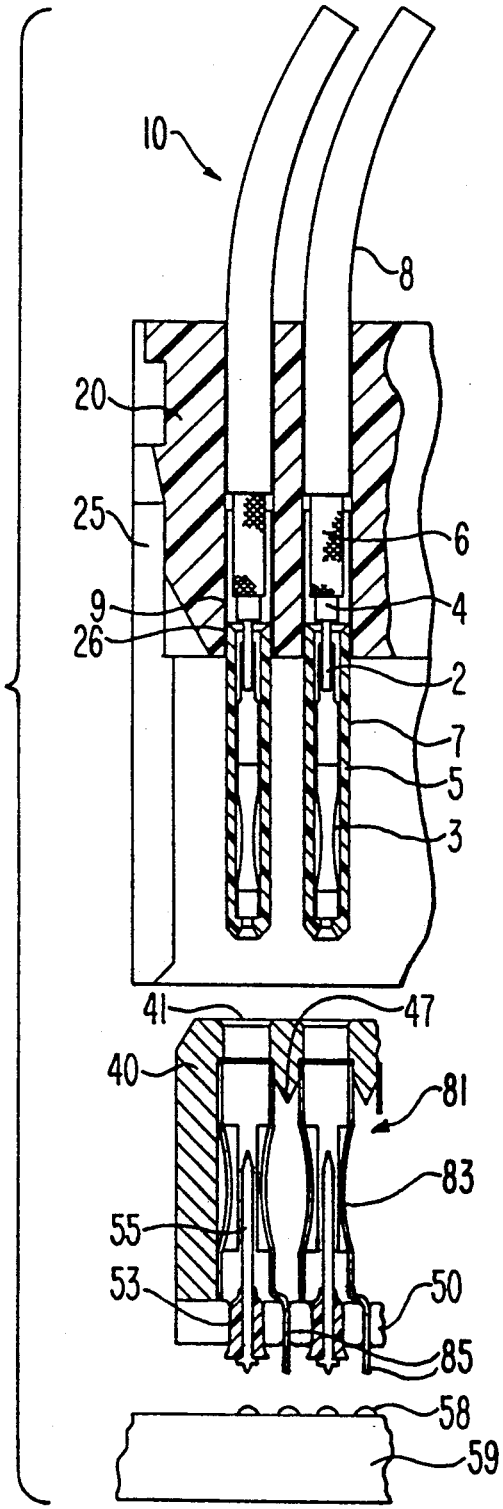
FIG. 5*b* is a cut-through side view of the assembled coaxial cable in the grouper frame and the assembled header frame with which it mates using an offset leg ground contact.

The complete assembly of the grouper including coaxial cable connector assembly and grouper module can be seen in cutaway cross-section of FIGS. 5–5*b*. Here, two coaxial connectors 10 comprising coaxial cable showing protective jacket 8, outer conductor braid 6, dielectric material 4, center conductor 2 attached to signal contact 3 and surrounded by insulator 5 and ground shell 7. The retention groove 9 is also shown on the exterior walls of ground shell 7 engaged with retention ridge 26 of the receptacle grooves 24 of grouper module 20. The entire assembly of grouper module 20 with coaxial connector 10 is housed within grouper frame 25.

Header frame 40 fits adjacent to grouper frame 25. The header frame 40 is made of a thermoplastic or metal and serves as a housing having four side walls and an upper face, the face of which has an array of receptacle holes 41 that are staggered in the same location as the grooves of the grouper modules 20 within the grouper frame 25. The header frame 40 also has holding means in the form of two extensions 43, containing holes 44, projecting from two opposite side walls as shown in FIGS. 1–1*b*. The holes 44 match the holes 29 of the grouper frame when the components are assembled.

Header frame 40 also has a plurality of alignment cones 47 that are positioned between the receptacle holes 41 on the underside of the top face of the header frame. The alignment cones have faces shaped to best fit the ground contacts 45. Although, not visible in FIG. 1–1*b*, these alignment cones 47 can be seen in FIGS. 5–5*b*. The cones 47 aid in directing and retaining ground contacts 45 within or adjacent to the receptacle holes 41 of the header frame 40.

A plurality of ground contacts 45 are positioned to fit between receptacle holes 41 of header frame 40 and receptacle holes 52 of header plate 50. The receptacle holes 52 of the header plate are in the same design configuration as the receptacle holes of the other components. Holes 99 for ground pins are also interspersed between the receptacle holes 52. Header plate 50 also has holding means in the form of extensions 51 projecting from the opposite sides of the plate with holes 54 that align and mate with holes of the grouper and header frames. The header plate 50 is made of a conductive metal preferably brass or copper. Alternatively, the header plate may be made of plastic such as liquid crystal polymer.

Figure 6:
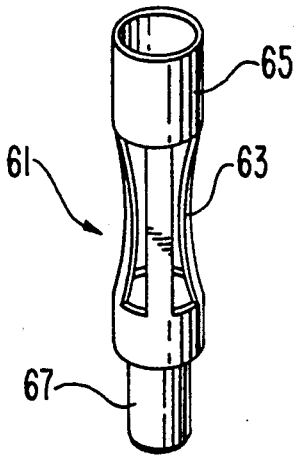
FIG. 6 shows an isometric view of the step-down ground contact of the header.
Figure 6A:
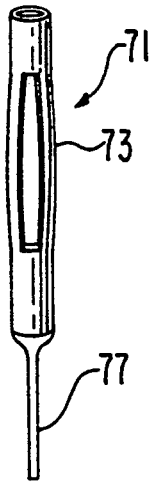
FIG. 6*a* shows an isometric view of the reverse four-beam ground contact.
Figure 6B:
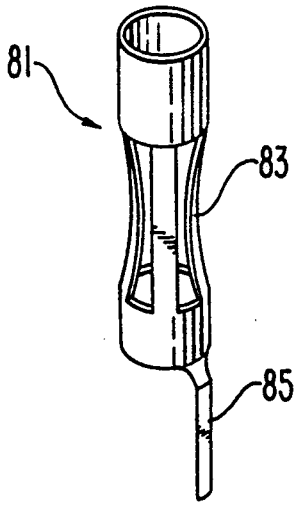
FIG. 6*b* shows an isometric view of the offset leg ground contact.

The plurality of ground contacts 45 may be one of several embodiments, including a step-down ground contact 61 as shown in FIGS. 1, 5, and 6, a reverse four-beam ground contact 71 shown in FIGS. 1*a*, 5*a*, and 6*a*, or an offset leg ground contact 81 shown in FIGS. 1*b*, 5*b*, and 6*b*. The ground contact, of any of these embodiments, completes the ground path from the shield 7 to the electrical signal transmission system.

One embodiment, shown in FIG. 6, and in use in FIGS. 1 and 5 is a step-down ground contact 61 having beams 63, preferably four beams, which are on the outside of the shell and project inward. This contact preferably made of a beryllium copper core that has been gold plated, also has an outer diameter at its upper region 65 that is larger than the diameter at its lower region 67. The contact is designed to have a smaller diameter in the lower region thereby requiring smaller diameter receptacle holes in the header plate 50 and thus ensuring strength in the header plate. FIGS. 1 and 5 show the construction of the header assembly 40 utilizing the ground contact of the step-down construction. Impedance in the header plate 50 is controlled by the geometry of pin 55 and the diameter of the step-down ground contact 71 as well as by material selection of the insulator 53.

Figure 7:
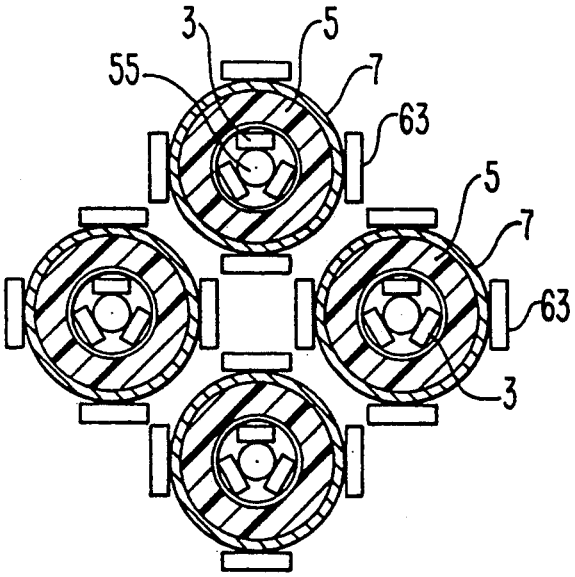
FIG. 7 shows a cross-sectional view of the step-down four-beam ground contacts at the point of contact between the signal pin and signal contact.

FIG. 7 shows a cross-sectional view of the step-down ground contact 61 at the location between the signal pin and signal contacts in which all of the beams 63 from the ground contact 61 are in contact with the ground shell 7 of adjacent signal contacts.

A second embodiment, shown in FIG. 6*a* is a reverse four-beam contact 71 which is a gold-plated beryllium copper core material stamped and formed four-beam contact having beams 73 that protrude outward. In this embodiment, each of the outwardly protruding beams 73 touches an adjacent shell 7 so that the beams 73 are deflected inwards towards the center of the contact. For this type of contact, the tail of the contact 71 is located along its center line and is used as the ground pin in the header thereby eliminating the need for an additional ground pin component 57.

Figure 7A:
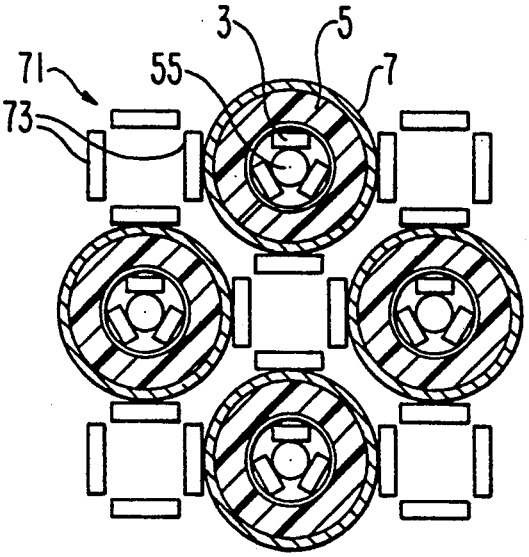
FIG. 7*a* shows a cross-sectional view of the reverse four-beam ground contact at the point of contact between the signal pin and signal contact.

FIG. 7*a* shows a cross-sectional view of reverse four-beam ground contacts at the point of contact between the signal pin and signal contacts.

A third embodiment of ground contact 45 is shown in FIG. 6*b* and location of it in conjunction within the assembly as shown in FIG. 5*b*. FIG. 6*b* is an isometric view of the offset leg ground contact 81 having at least one leg 85 offset. The offset leg ground contact 81 is similarly constructed from beryllium copper and gold-plated and is positioned and functions similar to that of the step-down ground contact 61 in that a signal pin is positioned within the ground contact and the beams 83 of the contact are deflected outward thereby touching the shields of adjacent contacts. The offset leg 85 serves as a ground pin thereby eliminating the need for a ground pin 57 and thus similar in function to the reverse four-beam contact. The cross-sectional view of the offset leg ground contact at the location between signal pin and signal contact is identical to that for the step-down ground contact (shown in FIG. 7).

The grouper assembly (including frame 25, and modules 20 containing coaxial cable connector assemblies 10) fit adjacent the header which houses one of the three types of ground contacts 45, signal pins 55 and header plate 50. For the step-down ground contact 61 or the offset leg ground contact 81, the ground shell 7 is disposed within the beams of one ground contact. A signal pin 55 also disposed within the ground contact and the pin mates with the signal contact 3. An insulator 53 surrounds the signal pin 55 to electrically isolate it from the header plate 50. For the embodiment using the step-down ground contact 61, a plurality of ground pins 57 are also required and are located between adjacent contacts/signal pins. For the embodiment with the offset leg ground contact, no ground pins are required as the offset leg 85 serves as the ground pin.

For the embodiment using the reverse four-beam ground contact, the ground shell 7 of a coaxial cable assembly is disposed adjacent to the ground contact 71. A ground pin 55 is disposed within the ground shell 7 and mates with the signal contact 3. The beams 73 from adjacent ground contacts 71 protrude out to contact adjacent shells 7. An insulator 53 also surrounds each signal pin 55 to electrically isolate it from the header plate. The tail 77 of the reverse four-beam ground contact protrudes through the header plate (similar to that of the offset leg embodiment) and thus serves as the ground pin. Hence no ground pins are required for this embodiment.

For all of these embodiments, the connection between the ground contact 45 and conductive metal header plate 50 may be reinforced by high temperature soldering, welding, or brazing. The signal pins 55 used in all embodiments are preferably made of phosphorus bronze or beryllium copper alloy. The insulator 53 is preferably made of liquid crystal polymer or polyetherimide. The ground pin 57, when required for the step-down ground contact embodiment is preferably made of phosphorus bronze or beryllium copper alloy and reinforced in place in a conductive metal header plate 50 by reflowed solder. For thermoplastic header plates 50, insulators 53 are not required for the signal pins 55. Contact and signal pins within a plastic header plate may be reinforced within the plate by press fitting, insert molding, or adhesive bonding.

Figure 8:
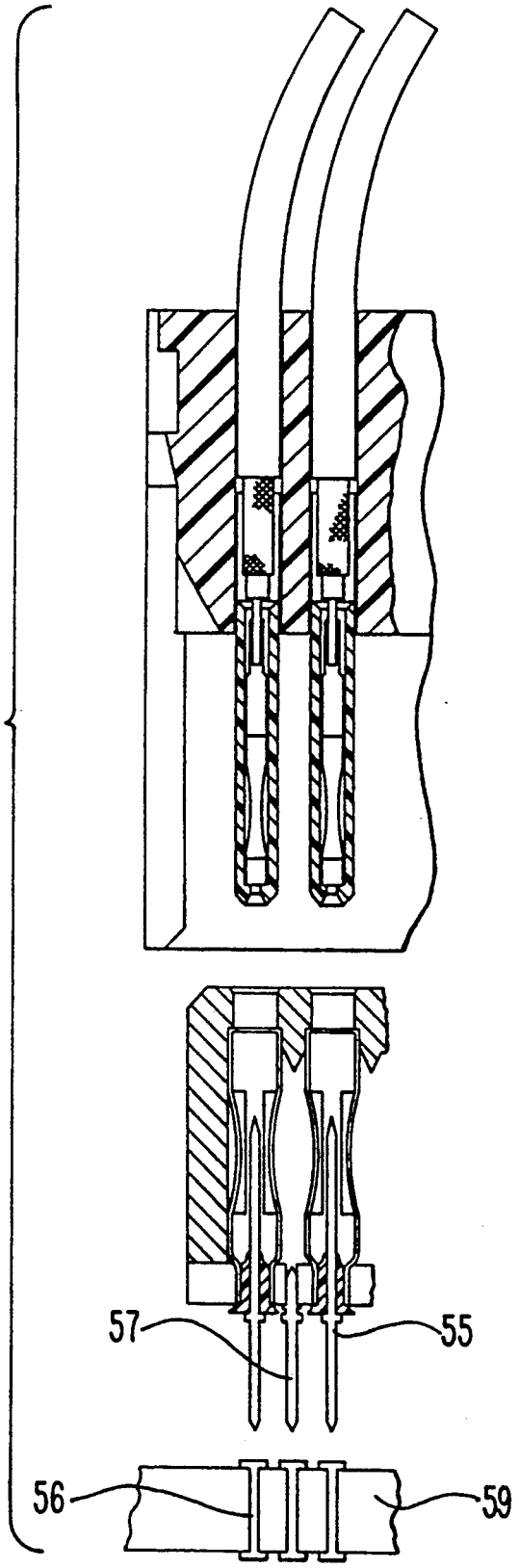
FIG. 8 is a cut-through side view of the assembled coaxial cable in grouper frame and assembled header frame with extended signal pins and ground pins to be mounted directly through plated holes of the printed circuit board.

In final assembly, the header frame 40, header plate 50 and all components fully assembled as shown in FIGS. **5–5*b* are mounted and soldered onto the surface mount pad 58 of the electrical signal transmission system, in this case the printed circuit board 59. Typically, this mounting achieves both physical and electrical connection. While surface mounting is preferable, the header pins and ground contacts may also be provided with additional length so as to fit into holes of a printed circuit board as shown in FIG. 8. With this type of construction, the signal pins 55, ground pins 57 (as shown in FIG. 8) or contact tails 77 or 85 are made sufficiently longer to fit within plated through holes 56** of the PC board into which they are typically soldered.

Grouper frame 25 with all component parts, including the plurality of coaxial connectors, is then mounted onto the header assembly and aligned by matching all holding means 30 of the different frames. The header frame, header plate and grouper frame are held together by holding means 30 such as thumb screw, jack screw, and jack nut as shown in FIG. 1. Alternative holding means include a variety of clips and clamps commonly utilized in the industry.

Because of the staggered array design and use of ground contacts with extending tails as described, a higher density of signal transmission components can be used. The resulting high-density coaxial cable connector system offers up to twice the concentration of cables that had previously been achieved (i.e. greater than 200 coaxial signals per square inch). Also, by using the grouper modules 20, cables may be easily replaced when damaged. These assemblies are also significantly lightweight as opposed to conventional assemblies due to the compactness and small size of the individual components as well as the substitution of lightweight thermoplastic materials for metal components.

We claim:

1. A high-density coaxial interconnect system comprising the components:

(a) a plurality of coaxial cable connectors, each connector further comprising:
  (i) a coaxial cable having a signal carrying center conductor surrounded by a dielectric material, further surrounded by an outer conductor and a polymeric jacket;
  (ii) a signal contact attached to the center conductor of the coaxial cable;
  (iii) a thermoplastic insulator surrounding the signal contact; and
  (iv) a ground shell surrounding the thermoplastic insulator, said shell having a retention groove surrounding its exterior face.

(b) at least one grouper module with interlocking means, said grouper module having rows with a plurality of receptacle grooves, wherein each groove is provided with a retention ridge on its interior surface and wherein the receptacle grooves are positioned within the grouper module in a staggered array so that the grooves are at a diagonal to each other with respect to the rows and wherein each retention ridge interacts with the retention groove of the ground shell so as to lock a coaxial cable connector within the receptacle groove of the grouper module;

(c) a grouper frame having four sides and interlocking means which houses the grouper module and secures the grouper module in place by engagement of the interlocking means of the grouper module and the grouper frame;

(d) a header frame comprising four side walls and a top face, said top face of the header frame having a plurality of receptacle holes that match the staggered array of receptacle grooves of the grouper module housed within the grouper frame and a plurality of alignment cones on the underside of the top face between receptacle holes;

(e) a plurality of step-down ground contacts, each having a diameter in the upper region of the contact greater than the diameter in the lower region, and beams that project inward, wherein each ground contact is positioned in a receptacle hole and stabilized by the alignment cones of the header frame, said ground contacts mate with the ground shells of the coaxial cable connector;

(f) a header plate having a plurality of receptacle holes in a staggered array matching the array of the receptacle holes of the header frame and also having a plurality of ground pin holes uniformly interspersed among the receptacle holes, said header plate positioned adjacent the plurality of step-down ground contacts opposite and parallel to the top face of the header frame;

(g) a plurality of alternating ground and signal pins, said ground pins positioned within the ground pin holes of the header plate and said signal pins, each surrounded by an insulator, positioned within the receptacle holes so as to mate with the signal contact; and (h) holding means for aligning and securing components of the assembly together.

2. A high-density coaxial interconnect system of claim 1 wherein said signal contact is a three-beam cylindrical body and tail.

3. A high-density coaxial interconnect system of claim 1 wherein said grouper module interlocking means are plastic tab projections and wherein said grouper frame interlocking means are indentations in which the plastic tab projections fit.

4. A high-density coaxial interconnect system of claim 1 wherein said grouper module and grouper frame interlocking means are selected from the group consisting of glues and adhesives.

5. A high-density coaxial interconnect system of claim 1 wherein said grouper module is made of a thermoplastic selected from the group consisting of liquid crystal polymers, polyetherimides, polybutylene terephthalate, polyethylene terephthalate, and nylons.

6. A high-density coaxial interconnect system of claim 1 wherein said interlocking means of grouper module and grouper frame are keys, in which the keys are on exterior walls of the module and interior walls of the grouper frame which cooperate to hold the grouper module within the grouper frame, and wherein said grouper module has shaped ends at a lower region of the module to aid in assemblying modules into the frame.

7. A high-density coaxial interconnect system of claim 1 wherein said header plate is made of metal selected from the group consisting of aluminum, zinc alloy, brass and copper alloy and wherein ground contact connection within the header plate and ground pin connection with the header plate are reinforced by solder.

8. A high-density coaxial interconnect system of claim 1 wherein said signal and ground pins are mounted on a surface of an electrical signal transmission system.

9. A high-density coaxial interconnect system of claim 1 wherein said signal and ground pins are extended and fit within holes of an electrical signal transmission system.

10. A high-density coaxial interconnect system of claim 1 wherein said holding means are selected from the group consisting of thumb screws, Jack screws, jack nuts, clips and clamps.

11. A high-density coaxial interconnect system of claim 1 further comprising a plurality of grouper modules that contain receptacle grooves in which coaxial cable connectors are located, said plurality of grouper modules housed within said grouper frame.

12. A high-density coaxial interconnect system of claim 2 wherein two hundred signal and ground pins occupy no more than one square inch of the header frame.

13. A high-density coaxial interconnect system comprising the components:

(a) a plurality of coaxial cable connectors, each connector further comprising:

(i) a coaxial cable having a signal carrying center conductor surrounded by a dielectric material, further surrounded by an outer conductor and a polymeric jacket;

(ii) a signal contact attached to the center conductor of the coaxial cable;

(iii) a thermoplastic insulator surrounding the signal contact; and (iv) a ground shell surrounding the thermoplastic insulator, said shell having a retention groove surrounding its exterior face.

(b) at least one grouper module with interlocking means, said grouper module having rows with a plurality of receptacle grooves, wherein each groove is provided with a retention ridge on its interior surface and wherein the receptacle grooves are positioned within the grouper module in a staggered array so that the grooves are at a diagonal to each other with respect to the rows and wherein each retention ridge interacts with the retention groove of the ground shell so as to lock a coaxial cable connector within the receptacle groove of the grouper module;

(c) a grouper frame having four sides and interlocking means which houses the grouper module and secures the grouper module in place by engagement of the interlocking means of the grouper module and the grouper frame;

(d) a header frame comprising four side walls and a top face, said top face of the header frame having a plurality of receptacle holes that match the staggered array of receptacle grooves of the grouper module housed within the grouper frame and a plurality of alignment cones on the underside of the top face between receptacle holes;

(e) a plurality of reverse four-beam ground contacts, each having beams that protrude outward and a tail that serves as a ground pin, each contact positioned between two receptacle holes and stabilized by the alignment cones of the header frame, said ground contacts mate with the ground shells of the coaxial cable connector;

(f) a header plate having a plurality of receptacle holes in a staggered array matching the array of the receptacle holes of the header frame and also having a plurality of ground pin holes uniformly interspersed among the receptacle holes, said header plate positioned adjacent the plurality of ground contacts opposite and parallel to the top face of the header frame;

(g) a plurality of signal pins, each surrounded by an insulator, positioned within the receptacle holes so as to mate with the signal contact; and (h) holding means for aligning and securing components of the assembly together.

14. A high-density coaxial interconnect system of claim 13 further comprising a plurality of grouper modules that contain receptacle grooves in which coaxial cable connectors are located, said plurality of grouper modules housed within said grouper frame.

15. A high-density coaxial interconnect system of claim 13 wherein said signal contact is a three-beam cylindrical body and tail.

16. A high-density coaxial interconnect system of claim 13 wherein said grouper module interlocking means are plastic tab projections and wherein said grouper frame interlocking means are indentations in which the plastic tab projections fit.

17. A high-density coaxial interconnect system of claim 13 wherein said grouper module and grouper frame interlocking means are selected from the group consisting of glues and adhesives.

18. A high-density coaxial interconnect system of claim 13 wherein said grouper module is made of a thermoplastic selected from the group consisting of liquid crystal polymers, polyetherimides, polybutylene terephthalate, polyethylene terephthalate, and nylons.

19. A high-density coaxial interconnect system of claim 13 wherein said interlocking means of grouper module and grouper frame are keys, in which the keys are on exterior walls of the module and interior walls of the grouper frame which cooperate to hold the grouper module within the grouper frame, and wherein said grouper module has shaped ends at a lower region of the module to aid in assemblying modules into the frame.

20. A high-density coaxial interconnect system of claim 13 wherein said header plate is made of metal selected from the group consisting of aluminum, zinc alloy, brass and copper alloy and wherein ground contact connection within the header plate and ground pin connection with the header plate are reinforced by solder.

21. A high-density coaxial interconnect system of claim 13 wherein two hundred signal and ground pins occupy no more than one square inch of the header frame.

22. A high-density coaxial interconnect system of claim 13 wherein said holding means are selected from the group consisting of thumb screws, jack screws, jack nuts, clips and clamps.

23. A high-density coaxial interconnect system of claim 13 wherein said signal and ground pins are mounted on a surface of an electrical signal transmission system.

24. A high-density coaxial interconnect system of claim 13 wherein said signal and ground pins are extended and fit within holes of an electrical signal transmission system.

25. A high-density coaxial interconnect system comprising the components:

(a) a plurality of coaxial cable connectors, each connector further comprising:
  (i) a coaxial cable having a signal carrying center conductor surrounded by a dielectric material,
  (ii) a signal contact attached to the center conductor of the coaxial cable;
  (iii) a thermoplastic insulator surrounding the signal contact; and
  (iv) a ground shell surrounding the thermoplastic insulator, said shell having a retention groove surrounding its exterior face;

(b) at least one grouper module with interlocking means, said grouper module having rows with a plurality of receptacle grooves, wherein each groove is provided with a retention ridge on its interior surface and wherein the receptacle grooves are positioned within the grouper module in a staggered array so that the grooves are at a diagonal to each other with respect to the rows and wherein each retention ridge interacts with the retention groove of the ground shell so as to lock a coaxial cable connector with the receptacle groove of the grouper module;

(c) a grouper frame having four sides and interlocking means which houses the grouper module and secures the grouper module in place by engagement of the interlocking means of the grouper module and the grouper frame;

(d) a header frame comprising four side walls and a top face, a top face, said top face of the header frames having a plurality of receptacle holes that match the staggered array of receptacle grooves of the grouper module housed within the grouper frame and a plurality of alignment cones on the underside of the top face between receptacle holes;

(e) a plurality of ground contacts that have at least one offset leg per ground contact, wherein each ground contact is positioned within a receptacle hole and stabilized by the alignment cones of the header frame, said ground contacts mate with the ground shells of the coaxial cable connector and said offset legs serve as a plurality of ground pins;

(f) a header plate having a plurality of receptacle holes in a staggered array matching the array of the receptacle holes of the header frame and also having a plurality of ground pin holes uniformly interspersed among the receptacle holes, said header plate positioned adjacent the plurality of offset leg ground contacts opposite to and parallel to the top face of the header frame.

(g) a plurality of signal pins, each surrounded by an insulator, positioned within the receptacle holes so as to mate with the signal contact; and (h) holding means for aligning and securing components of the assembly together.

26. A high-density coaxial interconnect system of claim 25 further comprising a plurality of grouper modules that contain receptacle grooves in which coaxial cable connectors are located, said plurality of grouper modules housed within said grouper frame.

27. A high-density coaxial interconnect system of claim 25 wherein said signal contact is a three-beam cylindrical body and tail.

28. A high-density coaxial interconnect system of claim 25 wherein said grouper module interlocking means are plastic tab projections and wherein said grouper frame interlocking means are indentations in which the plastic tab projections fit.

29. A high-density coaxial interconnect system of claim 25 wherein said grouper module and grouper frame interlocking means are selected from the group consisting of glues and adhesives.

30. A high-density coaxial interconnect system of claim 25 wherein said grouper module is made of a thermoplastic selected from the group consisting of liquid crystal polymers, polyetherimides, polybutylene terephthalate, polyethylene terephthalate, and nylons.

31. A high-density coaxial interconnect system of claim 25 wherein said interlocking means of grouper module and grouper frame are keys, in which the keys are on exterior walls of the module and interior walls of the grouper frame which cooperate to hold the grouper module within the grouper frame, and wherein said grouper module has shaped ends at a lower region of the module to aid in assemblying modules into the frame.

32. A high-density coaxial interconnect system of claim 25 wherein said header plate is made of metal selected from the group consisting of aluminum, zinc alloy, brass and copper alloy and wherein ground contact connection within the header plate and ground pin connection with the header plate are reinforced by solder.

33. A high-density coaxial interconnect system of claim 25 wherein two hundred signal and ground pins occupy no more than one square inch of the header frame.

34. A high-density coaxial interconnect system of claim 25 wherein said holding means are selected from the group consisting of thumb screws, jack screws, jack nuts, clips and clamps.

35. A high-density coaxial interconnect system of claim 25 wherein said thermoplastic material of the header plate is made from the group consisting of liquid crystal polymers, polyetherimides, polybutylene terephthalate, polyethylene terephthalate and nylons.

36. A high-density coaxial interconnect system of claim 25 wherein said signal and ground pins are mounted on a surface of an electrical signal transmission system.

37. A high-density coaxial interconnect system of claim 25 wherein said signal and ground pins are extended and fit within holes of an electrical signal transmission system.

* * * * *